US007415789B2

(12) United States Patent
Hluchan

(10) Patent No.: US 7,415,789 B2
(45) Date of Patent: Aug. 26, 2008

(54) ADVERTISING/PROMOTIONAL DISPLAY SYSTEM

(75) Inventor: Erik S. Hluchan, Deep River, CT (US)

(73) Assignee: Structural Graphics, LLC, Essex, CT (US)

( * ) Notice: Subject to any disclaimer, the term of this patent is extended or adjusted under 35 U.S.C. 154(b) by 300 days.

(21) Appl. No.: 11/328,853

(22) Filed: Jan. 9, 2006

(65) Prior Publication Data

US 2006/0168851 A1 Aug. 3, 2006

Related U.S. Application Data

(60) Provisional application No. 60/645,971, filed on Jan. 20, 2005.

(51) Int. Cl.
*G09F 7/00* (2006.01)

(52) U.S. Cl. ..... 40/488; 40/491; 40/124.06; 116/322; 116/323; 116/324; 434/405

(58) Field of Classification Search ..... 40/446, 40/488, 486, 124.06, 491; 116/321, 322, 116/323, 324; 434/405; 235/70 R
See application file for complete search history.

(56) References Cited

U.S. PATENT DOCUMENTS 418,135 A * 12/1889 Kaufmann ..... 40/491
1,696,987 A * 1/1929 Troidl ..... 434/95
2,119,839 A * 6/1938 Wild ..... 273/148 R
3,224,112 A * 12/1965 Hanson ..... 273/270
5,285,589 A * 2/1994 Hyatt ..... 40/375
5,778,578 A * 7/1998 Drapcho et al. ..... 40/491
6,061,938 A * 5/2000 Young ..... 40/490
2005/0278997 A1 * 12/2005 Burtch ..... 40/491

* cited by examiner

*Primary Examiner*—Gary C Hoge
(74) *Attorney, Agent, or Firm*—Melvin I. Stoltz

(57) ABSTRACT

By providing a unique, pre-printed housing within which a plurality of windows are formed and positioned for cooperating with a plurality of longitudinally movable arm members or sliders, a unique, hands-on, printed, visually exciting and interest generating advertising/promotional product is attained. In the preferred embodiment, each window incorporates a transparent panel for overlying the visual image contained in the window, as well as preventing the user from obtaining access to the visual information contained therein.

By constructing each of the plurality of longitudinally movable arm members/sliders in an overlying manner, a unique construction is realized which enables the movement of one arm member/slider to effectuate a change in the visual display of a window element which is not directly adjacent the arm member or slider. In this way, a unique, surprising and interest generating result is attained.

17 Claims, 4 Drawing Sheets

ADVERTISING/PROMOTIONAL DISPLAY SYSTEM

This application is related to U.S. Provisional Patent Application Ser. No. 60/645,971, filed Jan. 20, 2005 entitled ADVERTISING/PROMOTIONAL DISPLAY SYSTEM.

TECHNICAL FIELD

This invention relates to advertising/promotional display systems and, more particularly, to advertising/promotional display systems having movable display panels for providing visually exciting and interest generating products.

BACKGROUND ART

With the ever-increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed on developing eye-catching visual displays and promotional material which stand out as being visually unique in order to receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when activated or unfolded. However, in spite of the unique visual appearance generated by such products, the overall cost of production and complexity of the assembly of these systems has prevented such prior art systems from becoming popular.

Other prior art displays have attempted to generate consumer interest by providing unique visual images or other indicia as an integral part of the display. However, these prior art attempts have also failed to generate the consumer interest being sought, largely due to an inability to physically involve the consumer in the promotion or display operation.

Therefore, it is a principal object of the present invention to provide a printed advertising or promotional product which is capable of being produced at a reasonable cost and provides an exciting, interest generating display.

Another object of the present invention is to provide a printed advertising or promotional product having the characteristic features described above, which enables the consumer to physically control the presentation of the display in a unique, hands-on manner.

Another object of the present invention is to provide a printed advertising or promotional product having the characteristic features described above, which is capable of mass production and assembly.

A further object in the present invention is to provide a printed advertising or promotional product having the characteristic features described above, which provides a unique, eye-catching, exciting and surprising visual change which is produced in response to action taken by the consumer.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest generating advertising/promotional product is attained. This desirable and previously unattainable result is realized in the present invention by providing a unique, pre-printed housing within which a plurality of windows are formed and positioned for cooperating with a plurality of longitudinally movable arm members or sliders. In the preferred embodiment, each window incorporates a transparent panel for overlying the visual image contained in the window, as well as preventing the user from obtaining access to the visual information contained therein.

By constructing each of the plurality of longitudinally movable arm members/sliders in an overlying manner, a unique construction is realized which enables the movement of one arm member/slider to effectuate a change in the visual display of a window element which is not directly adjacent the arm member or slider. In this way, a unique, surprising and interest generating result is attained. In the preferred construction, four separate and independent window elements are formed in the housing, in combination with four separate and independent, longitudinally movable arm members/sliders.

In one preferred embodiment, a separate and distinct visually exciting and interest generating indicia or visual display is printed in association with each window member of the housing, with one longitudinally movable arm member/slider being constructed for cooperative association with one window element. In the preferred construction, the longitudinal movement of the arm member/slider transforms a first visible image into a second visual image. This transformation may be achieved either by employing transparent overlying members with visual images printed thereon or by actually printing a first image on the arm members/slider which is moved away from the window via the movement of the arm member.

In addition, in the preferred construction of the present invention, each longitudinally movable arm member/slider incorporates printed indicia formed on the exposed surface of the arm member which is revealed as the arm member is advanced outwardly from the housing. In this way, a unique, specific, targeted message can be conveyed to the consumer which is specifically related to the visual image being displayed by the movement of that particular arm member. In this way, the consumer has an active role in creating and enjoying the display being presented, as well as being informed with desired information the sponsor of the advertising/promotional product wishes to convey.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

Figure 1:
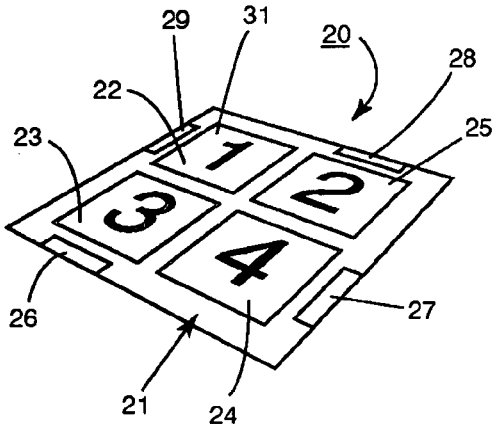
FIG. 1 is a perspective view of one embodiment of the visually exciting and interest generating advertising/promotional product of the present invention.

By referring to FIGS. 1-12, along with the following detailed discussion, the construction and operation of alternate preferred embodiments of advertising/promotional product 20 of the present invention can best be understood. The present invention, however, may be implemented in a wide variety of further alternate constructions. Consequently, it is to be understood that the embodiments detailed herein and shown in the drawings are provided for exemplary purposes only and are not intended as a limitation of the scope of the present invention.

In FIGS. 1-5, a first preferred embodiment of visually exciting and interest generating advertising/promotional product 20 of the present invention is depicted. In this embodiment, advertising/promotional product 20 comprises housing 21 which incorporates four separate and independent window members 22, 23, 24, and 25 and four separate and independent elongated arm members or sliders 26, 27, 28, and 29. As fully detailed below, by placing the desired indicia for display in window members 22, 23, 24, and 25, as well as placing cooperating, message related indicia on the exposed surfaces of elongated arm member/sliders 26, 27, 28, and 29, a visually exciting and interest generating advertising/promotional product 20 is realized. In addition, advertising/promotional product 20 provides an eye-catching visual display, with any desired relevant information being conveyed to the consumer.

In accordance with the present invention any desired number of windows and any desired number of arm members/sliders can the employed without departing from the scope of the present invention. In the preferred construction, the incorporation of four windows and four arm members/sliders has been found to provide an optimum visual display, which is capable of generating consumer interest while also being visually exciting. However, any desired number of windows and arm members/sliders can be employed without departing from the scope of the present invention.

Figure 4:
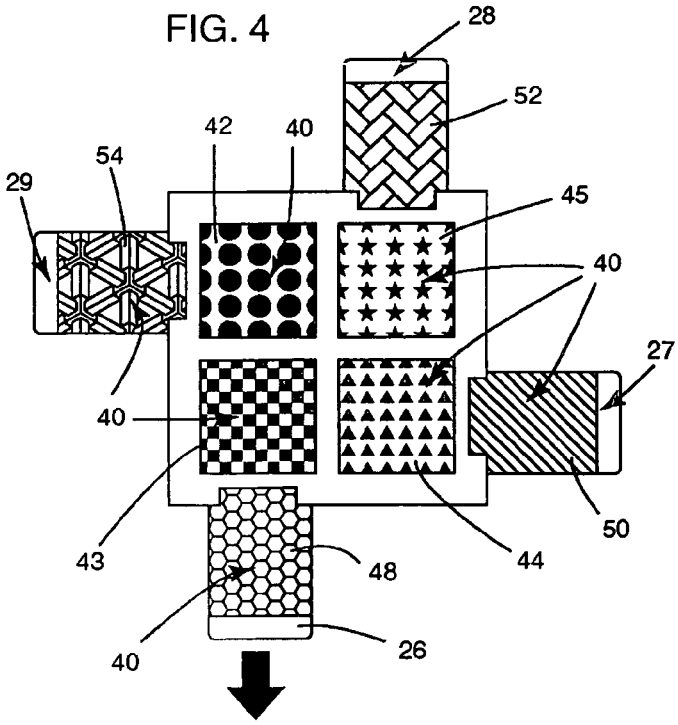
FIG. 4 is a top plan view of the visually exciting and interest generating advertising/promotional product of FIG. 1, shown with all four longitudinally extending arm members/sliders fully extended outwardly from the housing.
Figure 5:
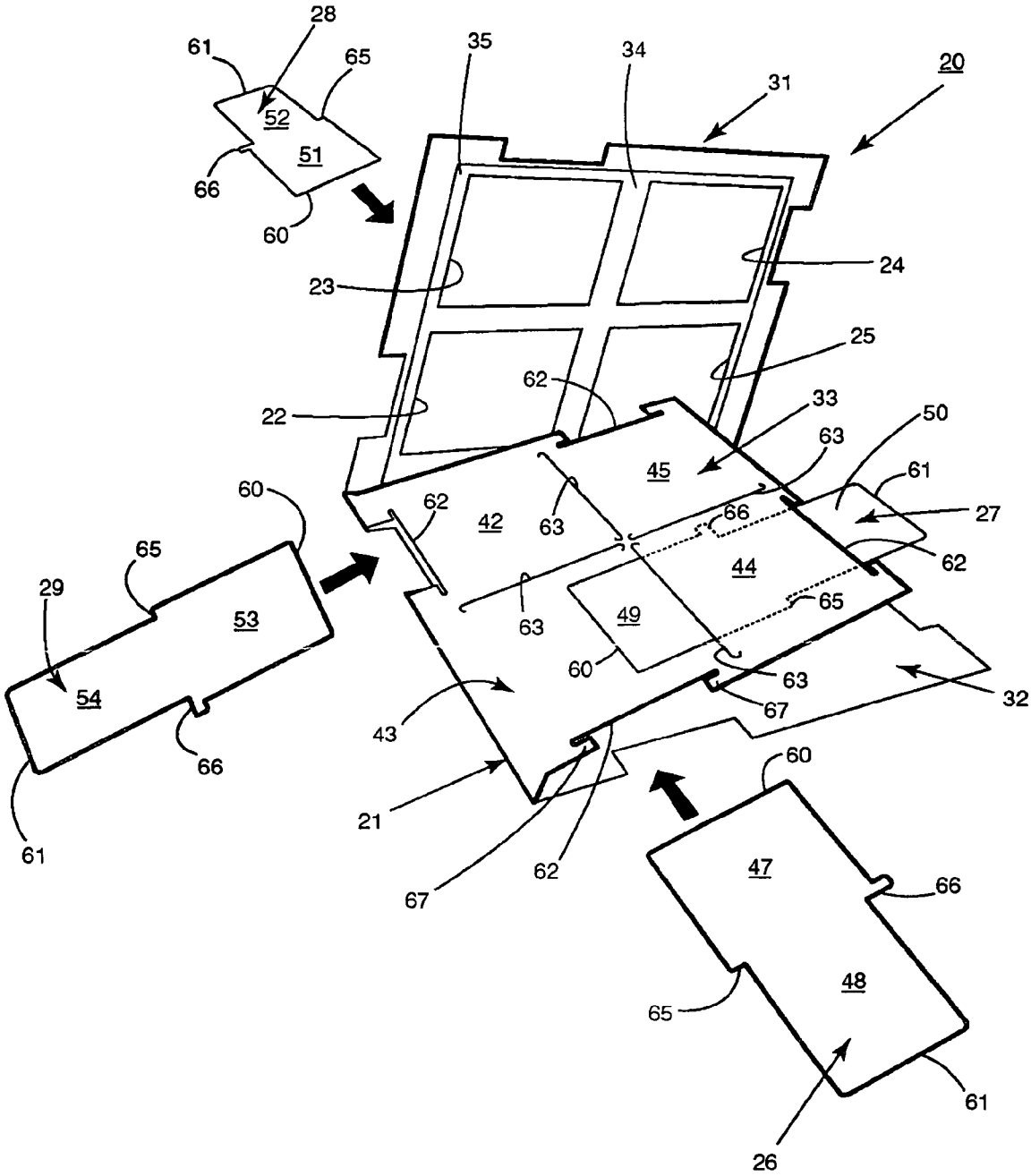
FIG. 5 is an exploded perspective view of the visually exciting and interest generating advertising/promotional product of FIG. 1.

In constructing visually exciting and interest generating advertising/promotional product 20, a plurality of alternate configurations can be employed. However, in the preferred construction, as in depicted in FIGS. 1-5, advertising/promotional product 20 is constructed comprising front panel 31, rear panel 32, and interior panel 33. If desired, as shown in FIG. 5, front panel 31 may comprise frame number 34 in combination with enlarged sheet 35 of transparent material. In this way, the desired four windows 22, 23, 24, and 25 are easily configured.

In the preferred construction of this embodiment of the present invention, interior panel 33 of housing 21 incorporates four separate and independent printed zones 42, 43, 44, and 45 formed thereon, each of which are positioned for being viewable through one of the windows 22, 23, 24, and 25. In addition, each of the printed zones 42, 43, 44, and 45 incorporates a desired visual and/or alphanumeric message desired by the sponsor of advertising/promotional product 20. For purposes of convenience and complete disclosure, FIG. 4 depicts zones 42, 43, 44, and 45 with separate, independent, and distinctive images or indicia 40 formed therein. However, indicia 40 is for exemplary purposes only and any desired alphanumeric or visual indicia message can be employed.

In order to enhance the visual excitement and interest generated by advertising/promotional product 20, each elongated, longitudinally extending arm member/slider 26, 27, 28, and 29 incorporates two separate and independent zones in which precisely desired printed indicia are formed. As shown, arm member/slider 26 incorporates printed zones 47 and 48, while arm member/slider 27 incorporates printed zones 49 and 50. Similarly, arm members/slider 28 incorporates printed zones 51 and 52, while arm member/slider 29 incorporates printed zones 53 and 54.

As discussed above in regard to the printed zones formed on interior panel 33, printed zones 47, 48, 49, 50, 51, 52, 53 and 54 of the arm members/sliders each comprise separate and independent indicia 40 printed therein. In this way, a wide variety of visual and/or alphanumeric information is capable of being conveyed to the consumer in a unique manner. By employing the present invention, the consumer is able to experience a hands-on interaction with advertising/promotional product 20 in order to cause all of the indicia contained in the printed zones to be fully displayed.

In accordance with the present invention, any desired printed indicia 40 can be formed in the receiving zones of advertising/promotional product 20. In this regard, indicia 40 may comprise one or more selected from the group consisting of messages and/or displays which consists of alphanumeric, visual, pictorial, graphic, symbols, logos, pictures, and/or color coded information. As a result, by employing advertising/promotional product 20 of the present invention, any message or display desired by a sponsor for being conveyed to a consumer is easily achieved in a unique, visually exciting and interest-generating manner.

Figure 3:
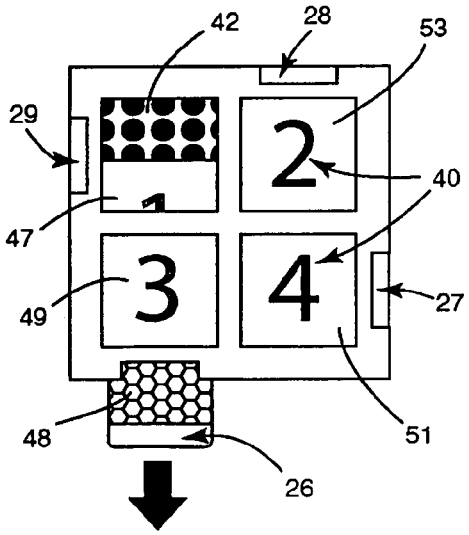
FIG. 3 is a top plan view of the visual exciting and interest generating advertising/promotional product of FIG. 1, shown with one longitudinally extending arm member/slider partially extended from the housing.

In the preferred construction of this embodiment of the present invention, each arm member/slider 26, 27, 28, and 29 is constructed and is cooperatively engaged with housing 21 for enabling one printed zone thereof to be continuously visible through one of the four windows of front panel 31 when the arm member/slider is fully engaged with housing 21. In addition, whenever the arm member/slider is longitudinally extended outwardly from housing 21, the previously visible printed zone is moved into a position in which the printed zone is no longer visible, while the second printed zone thereof becomes visible as the arm member/slider is fully extended outwardly from housing 21. This operation is best seen in FIGS. 3, and 5 and is fully detailed below.

Figure 2:
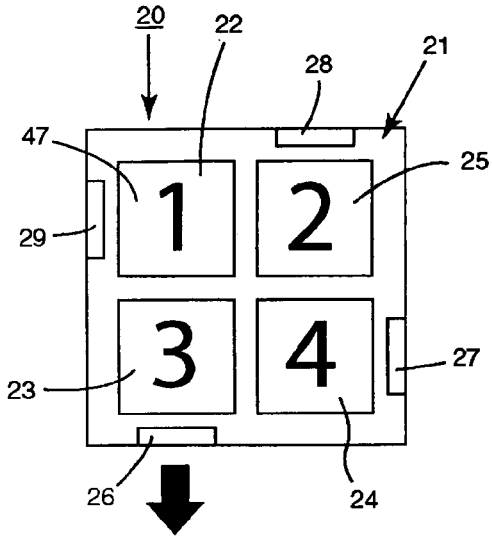
FIG. 2 is a top plan view of the visually exciting and interest generating advertising/promotional product of FIG. 1.

As shown in FIGS. 1 and 2, printed zone 47, which contains the numeral "1" as indicia 40, is readily visible through window 22 of housing 21 when arm member/slider 26 is fully engaged with housing 21. However, whenever arm member/slider 26 is longitudinally moved outwardly from housing 21, as shown in FIG. 3, printed zone 47 moves into a position wherein zone 47 is hidden, while printed zone 48 extends outwardly from housing 21 and becomes visible. Simultaneously therewith, the movement of printed zone 47 causes printed zone 42 of interior panel 33 to become visible through window 22, thereby revealing indicia 40 of printed zone 42.

Similarly, each of the arm members/sliders 27, 28, and 29 all operate in an identical manner, with one printed zone thereof being continuously visible through an associated window whenever the arm member/slider is engaged with housing 21. However, whenever the arm member/slider is moved outwardly from housing 21, the previously visible printed zone becomes hidden while the second printed zone thereof becomes visible as the printed zone of the arm member/slider extends outwardly from housing 21.

In addition, the printed zone of interior panel 33 which is positioned below the associated window of front panel 31 becomes visible as the first printed zone of the arm member/slider moves into its hidden position. By referring to FIGS. 4 and 5, this construction and operation can best be understood, with all of the printed zones associated with interior panel 33 being shown in their fully displayed configuration, while all of the printed zones of arm member/sliders 26, 27, 28, and 29, which become visible when the arm member/sliders are extended from housing 21, are also fully displayed.

As shown in FIG. 5, in order to achieve this visually exciting and interest generating construction for advertising/promotional product 20, interior panel 33 of housing 21 incorporates a plurality of slots formed therein associated with the each of the printed zones 42, 43, 44, and 45 formed thereon. By employing this construction, each arm member/slider 26, 27, 28, and 29 is cooperatively associated with interior panel 33 by being interleaved with a portion of interior panel 33.

In the preferred construction, as best seen in FIG. 5, each arm member/slider 26, 27, 28, and 29 incorporates a leading edge 60 and a trailing edge 61. In addition, interior panel 33 is constructed with each printed zone 42, 43, 44, and 45 incorporating a leading slot 62 and a trailing slot 63. Furthermore, in order to achieve the desired construction, and attain the operation detailed above, arm member/slider 26 is interleaved with interior panel 33 by having its leading edge 60 inserted through slot 62 of printed zone 43 in a manner which causes printed zone 47 thereof to be positioned below printed zone 43. Thereafter, leading edge 60 is advanced through slot 63 of printed zone 43 in order to enable printed zone 47 thereof to be placed in position above printed zone 42 of interior panel 33.

By employing this construction, printed zone 47 of arm members/slider 26 is continuously visible through window 22 when arm member/slider 26 is engaged with housing 21. However, whenever arm members/slider 26 is advanced outwardly from housing 21, printed zone 47 passes below printed zone 43 of interior panel 33, preventing printed zone 47 from being visible. Simultaneously therewith, printed zone 48 of arm member/slider 26 becomes visible as printed zone 48 extends outwardly from housing 21. Furthermore, printed zone 42 of interior panel 33 becomes visible as printed zone 47 of arm member/slider 26 is withdrawn from covering printed zone 42, revealing indicia 40 contained in printed zone 42.

Each of the remaining arm members/sliders 27, 28, and 29 are constructed in an identical manner in order to control the display of all of the remaining printed zones of interior panel 33 as well as the printed zones of each of the arm members/sliders. In this way, the desired controlled visual display of the plurality of printed zones formed in advertising/promotional product 20 is achieved and a unique, eye-catching, visually stimulating, interest generating product is realized.

In order to assure a smooth, continuous, and easily repeated operation, each arm member/slider 26, 27, 28, and 29 incorporates stop means to control the movement of each arm member/slider when fully extended from housing 21. In this way, assurance is provided that each arm member/slider is easily, repeatedly inserted into housing 21, as well as withdrawn therefrom, with only the desired indicia being displayed, while preventing unwanted, complete removal of any arm member/slider from housing 21.

In this regard, in order to achieve the desired result, in an efficient and easily manufactured construction, each arm member/slider 26, 27, 28, and 29 incorporates outwardly extending abutment stop flanges 65 and 66 formed on opposed side edges thereof at the juncture between the adjacent printed zones thereof. As shown in FIG. 5, arm member/slider 26 incorporates stop flanges 65 and 66 formed along the side edges thereof at the juncture between printed zones 47 and 48. Similarly, arm member/slider 27 incorporates abutment stop flanges 65 and 66 formed at the juncture between printed zones 49 and 50, while arm member 28 incorporates abutment stop flanges 65 and 66 formed at the juncture between printed zones 51 and 52. Finally, arm member/slider 29 incorporates abutment stop flanges 65 and 66 formed along the side edges thereof at the juncture between printed zones 53 and 54.

In addition, in the preferred construction, each slot 62 formed on interior panel 33 cooperates with a pair of locking fingers 67 which are formed directly adjacent slot 62 and extend along a portion of slot 62, positioned in juxtaposed, facing relationship to each other. By incorporating locking fingers 67 in association with slot 62, abutment stop flanges 65 and 66 are able to be quickly and easily inserted through slot 62 for cooperative sliding engagement with housing 21. In addition, this construction prevents each arm member/slider from being fully withdrawn from housing 21 due to the contacting interengagement of abutment stop flanges 65 and 66 with locking figures 67.

In this way, whenever an arm member/slider is moved from its first, retained position in housing 21 to its second, extended position, as shown in FIG. 4, abutment stop flanges 65 and 66 of each arm member/slider are brought into contact with fingers 67 of slot 62, preventing the longitudinal movement of the arm member/slider beyond the desired position. As a result, the precisely desired visual impact and indicia display is provided, while also assuring a smooth operating, visually impressive promotional display. Furthermore, as is evident from the foregoing detailed disclosure, this embodiment of the present invention provides a visually exciting and interest generating advertising/promotional product which enables the user to realize enhanced excitement and enjoyment, due to the hands-on interaction the user is required to provide in order to fully use and enjoy advertising/promotional product 20.

In addition to the embodiment of the present invention depicted in FIGS. 1-5 and fully detailed above, the present invention may also be implemented in an alternate embodiment depicted in FIGS. 6-9 and fully detailed below. By referring to FIGS. 6-9, along with the following detailed discussion, the construction and operation of this second, alternate preferred embodiment of the present invention can best be understood.

As depicted, in this embodiment, as with the embodiment detailed above, visually exciting and interest generating advertising/promotional product 20 comprises housing 21 which comprises front panel 31, rear panel 32, and interior panel 33. In the preferred construction, front panel 31 comprises frame 34 which establishes four separate and independent window members 22, 23, 24, and 25. In addition, housing 21 also incorporates enlarged sheet 35 formed of transparent material which is affixed to the inside surface of front panel 31 in association with window members 22, 23, 24, and 25. Finally, advertising/promotional product 20 also incorporates four separate and independent elongated arm members or sliders 26, 27, 28, and 29.

In this embodiment, each arm member/slider 26, 27, 28, and 29 is formed with two cooperating, adjacent surfaces or zones 71 and 72, with zone 71 preferably being devoid of any printed material or indicia, while zones 72 incorporates any desired printed indicia formed thereon. Furthermore, in this embodiment, transparent sheet 35 is constructed with printed indicia 70 formed thereon.

As a result, by employing this construction, zone 71 of arm members/sliders 26, 27, 28, and 29 provides a background or emphasizing panel which enhances the visual display of indicia 70 printed on transparent sheet 35. Furthermore, by forming any desired indicia on zones 72 of arm members/sliders 26, 27, 28, and 29, any desired message or indicia including colors, images, slogans, logos, alphanumeric designations, and the like, are able to be displayed and communicated to the user upon activation.

By employing this embodiment of the present invention, a uniquely constructed, visually exciting, and interest generating display is realized. In particular, by printing indicia 70 on transparent sheet 35 and employing zones 71 of arm members/sliders 26, 27, 28, and 29 as a background for enhancing or emphasizing the appearance of indicia 70, a unique, visually exciting and interest generating construction is realized. If desired, zones 71 may be formed as a plain, white, or opaque backgrounds devoid of any color for use in emphasizing indicia 70 of transparent sheet 35. Alternatively, zones 71 may be formed with identical or different colored surfaces for providing a different, visually distinctive impression and emphasis to indicia 70 formed on transparent sheet 35. However, regardless of which configuration is preferred, this embodiment of the present invention differs from the embodiment detailed above by eliminating specific printed indicia formed in zones 71 of arm members/sliders 26, 27, 28, and 29.

In this embodiment, similar to the embodiment detailed above, interior panel 33 of housing 21 incorporates four separate and independent printed zones 42, 43, 44, and 45 formed thereon. Each of the printed zones formed on panel 33 is positioned for being viewable through one of the window members 22, 23, 24, and 25, whenever arm member/slider associated therewith has been axially withdrawn from housing 21. By placing, printing, or otherwise positioning the desired indicia for display on interior panel 33 of housing 21 in alignment with window members 22, 23, 24, and 25, the desired visually exciting and interest generating advertising/promotional product 20 is attained. In addition, as is further detailed below, this visual excitement and interest is further enhanced by employing cooperating indicia, images, and the like on transparent panel 35 and printed zones 42, 43, 44, and 45. In this way, a strikingly unique and interest generating construction is realized.

Figure 6:
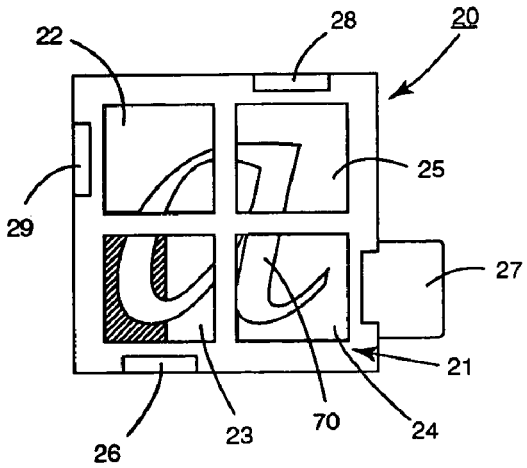
FIGS. 6-8 are perspective views of another embodiment of visually exciting, interest generating advertising/promotional product of the present invention shown in the process of having the movable arm members/sliders activated.
Figure 7:
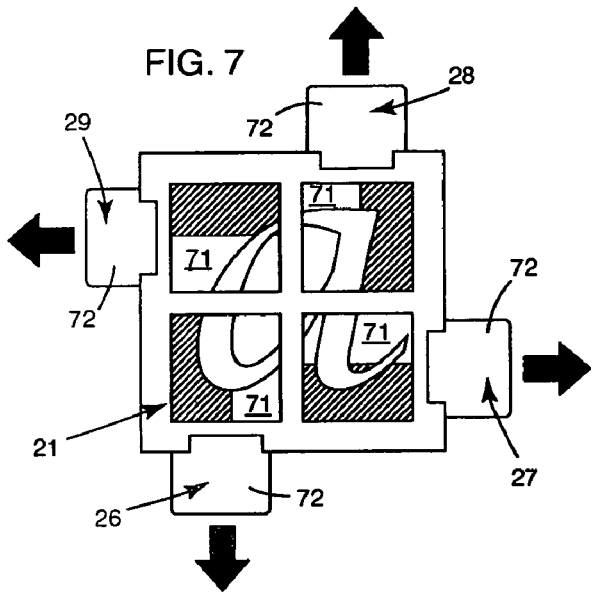
Figure 8:
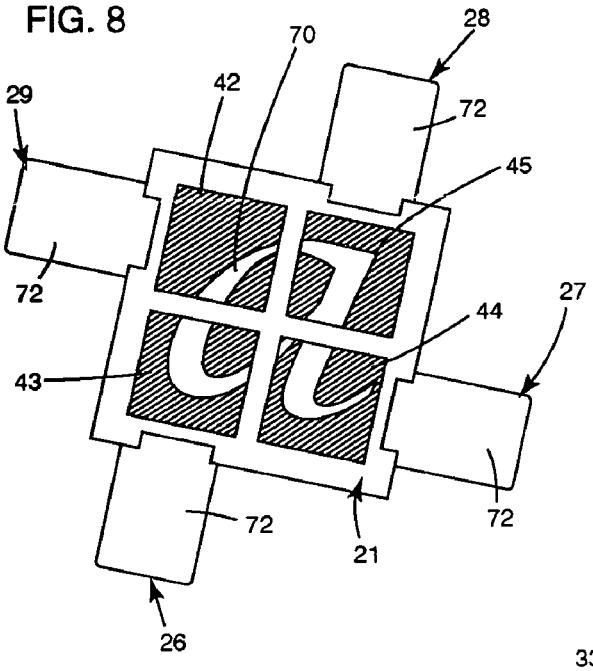

In the preferred construction of this embodiment of the present invention, indicia 70 printed on transparent panel 35 of housing 21 preferably comprises an outline or basic element for display, which is devoid of any color, detail, or emphasis. For exemplary purposes, this is depicted in FIGS. 6-8 as the letter "A", in script form. Although this graphic representation incorporates the same indicia cooperatively associated with all of the window members 22, 23, 24, and 25, separate and distinct images may be placed on transparent sheet 35 with each separate image appearing in each of the window members. However, regardless of which format is employed, the image would preferably comprise a simple outline or basic visual depiction.

In order to provide the visual excitement and generate substantial interest in advertising/promotional product 20 of the present invention, printed zones 42, 43, 44, and 45 incorporate the identical indicia 70 printed on transparent panel 35 along with enhancements associated therewith. In the depiction provided in FIGS. 6-8, the visual enhancements are shown as shading or coloring associated with indicia 70 in order to provide added distinguishing visual features thereto. However, as would be evident to one having ordinary skill in the art, any desired emphasis, color, imagery, symbols, alphanumeric designations, etc. can be employed in printed zones 42, 43, 44, and 45 with an equal efficacy.

By employing the construction detailed above, a visually unique presentation is produced. In this regard, as each arm member/slider 26, 27, 28, and 29 is longitudinally withdrawn from housing 21, background panel 71 of each arm member/slider is moved, causing the associated printed zone 42, 43, 44, and 45 to be revealed. However, since indicia 70 is printed on transparent sheet 35 and is duplicated in panels 42, 43, 44, and 45, along with visually distinctive and enhancing elements, the movement of arm members/sliders 26, 27, 28 and 29 causes the user to observe a seemingly magical addition of color or other elements appearing as panel 71 is withdrawn from view.

Since panel 71 comprises no indicia and merely emphasizes indicia 70 as printed on transparent sheet 35, the movement of panel 71 causes the magical appearance of color or other elements simultaneously with the movement of panel 71. This unique construction stimulates the visual senses and achieves a mystical, interest generating presentation which has been incapable of being achieved in prior art constructions.

Figure 9:
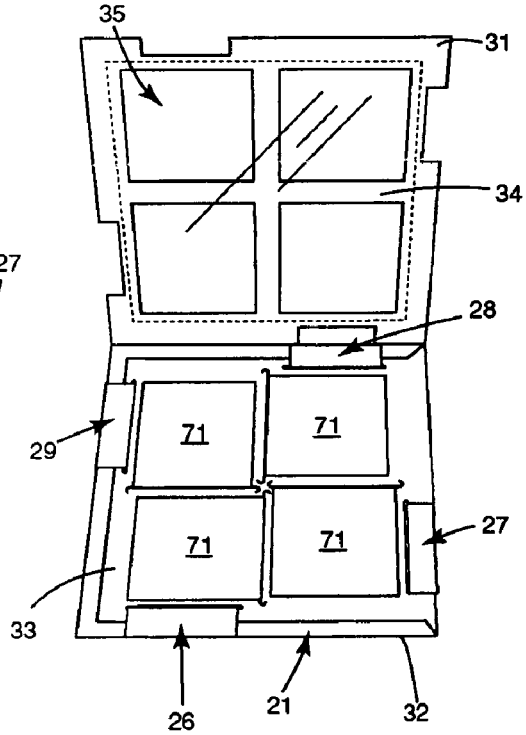
FIG. 9 is an exploded perspective view of the visually exciting, interest generating advertising/promotional product of FIG. 6.

As best seen in FIG. 9, the remaining construction of this embodiment of the present invention is substantially identical to the embodiment detailed above as shown in FIG. 5. In order to prevent unnecessary repetition regarding this preferred construction of the present invention, the detailed disclosure provided above is hereby repeated and incorporated by reference. Consequently, reference to the earlier disclosure, particularly in regard to the construction and operation of the present invention relative to FIG. 5, including its construction, interleaved configuration, and locking system, is hereby repeated and incorporated by reference.

Figure 10:
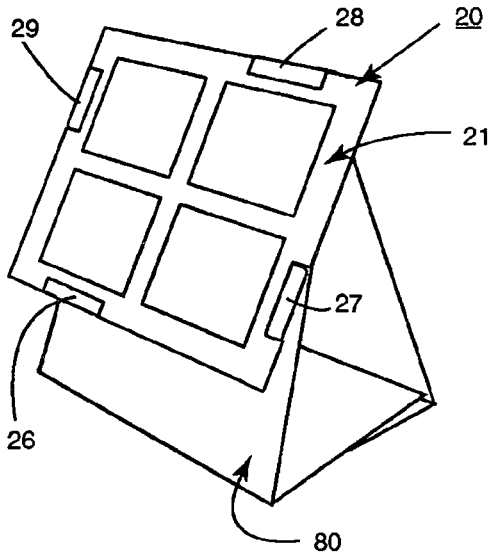
FIG. 10 is a perspective view of the visually exciting, interest generating advertising/promotional product of the present invention in combination with a support stand.
Figure 11:
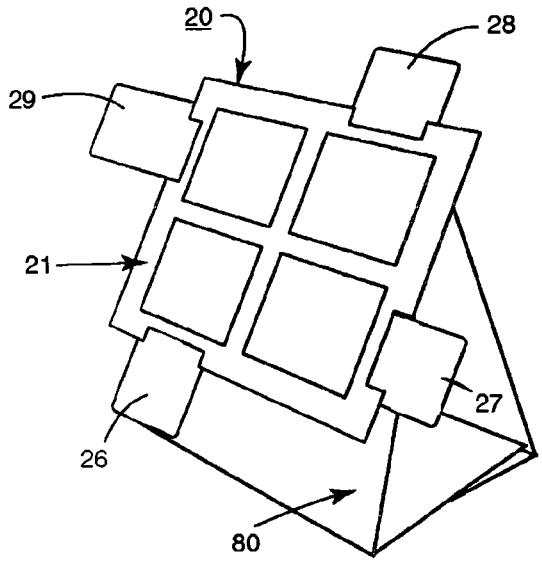
FIG. 11 is a perspective view of the visually exciting, interest generating advertising/promotional product of FIG. 10 shown fully activated.
Figure 12:
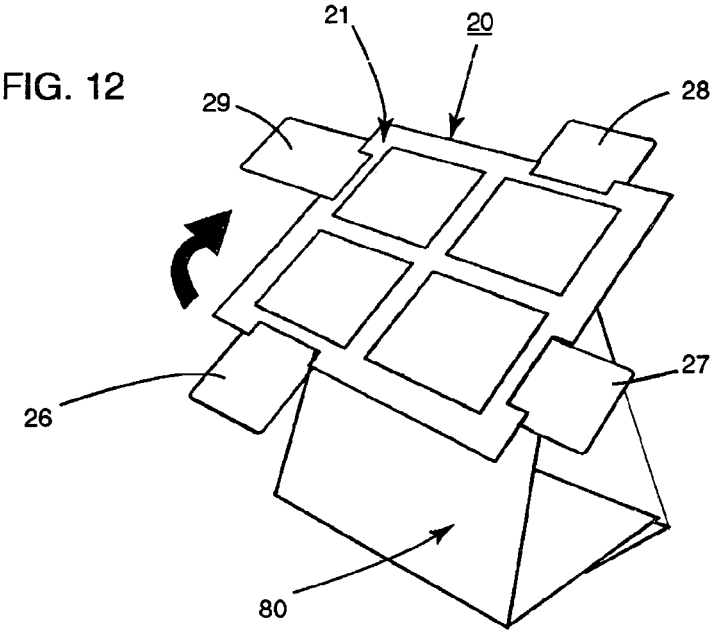
FIG. 12 is a perspective view of the visually exciting, interest generating advertising/promotional product of FIG. 11 and shown arcuately rotated.

In most applications, advertising/promotional product 20 of the present invention is constructed as a separate standalone product which is distributed to consumers or users the sponsor of product 20 wishes to receive and enjoy. However, as depicted in FIGS. 10-12, advertising/promotional product 20 may be constructed as an integral component of a support stand for use in a wide variety of alternate products or displays. In this regard, unique presentations for bars, restaurants, and the like can be created and widely employed.

As shown in FIGS. 10-12, advertising/promotional product 20 is mounted to support base 80, which is depicted as a triangular shaped table tent support. Although the triangular shaped table tent/support is shown, any desired support base of any desired configuration can be employed with equal efficacy.

By employing this embodiment of the present invention, wherein housing 21 of advertising/promotional product 20 is secured to support base 80, advertising/promotional product 20 is capable of being supportingly held in a raised and easily accessible position, completely resting on any desired table or surface.

By employing this construction, any user is able to employ advertising/promotional product 22 and enjoy the eye-catching and visually distinctive presentations provided thereby without physically holding advertising/promotional product 20. In this way, ease and convenience of use is attained. Furthermore, as shown in FIG. 11, by employing support base 80, all of the arm members/sliders 26, 27, 28, and 29 are easily accessed by the user, particularly arm member/slider 26 which is formed along the bottom edge of housing 21.

In an alternate embodiment, as depicted in FIG. 12, support base 80 is constructed to enable housing 21 of advertising/promotional product to be arcuately rotated about a central, longitudinal axis thereof, in order to enable arm member/slider 26, formed on the bottom edge of housing 21 to be quickly and easily reached. Furthermore, by employing this embodiment, each of the other arm members/sliders can also be quickly and easily positioned in a precisely desired location for optimum use.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

The invention claimed is:

1. An advertising/promotional display product constructed for providing a visually exciting and interest generating display, said product comprising:

A. a first panel member incorporating a) a plurality of separate and independent zones formed on one surface thereof, b) each of said separate and independent zones incorporating a unique indicia formed therein, and c) a pair of slots formed adjacent the side edge of each indicia bearing zone in juxtaposed, spaced, parallel relationship with each other;

B. a second panel member constructed for being in cooperative, overlying relationship with said first panel member and incorporating a plurality of separate and independent cut out zones, each of said cut out zones being dimensioned for cooperating with one of said indicia bearing zones of the first panel member for enabling said indicia to be viewable through said cut out zone; and C. a plurality of arm members or sliders with each of said members/sliders a) comprising a first section and an adjacent second section and being cooperatively associated with the first panel member and the second panel member for being slidingly movable between a first panel engaged position, wherein the arm member/slider is substantially fully engaged with the panel members, and a second panel disengaged position, wherein at least a portion of the arm members/slider is removed from the panel members, and b. being associated with at least two indicia bearing zones of the first panel member with the first section of the arm member/slider being positioned in overlying, blocking relationship with one of the indicia bearing zones of the first panel member for preventing the indicia from being viewable when said arm member/slider is in its first position and revealing the indicia when the arm member/slider is in its second position, while the second section of the arm member/slider extends through the cooperating slots associated with the adjacent indicia bearing zone;

whereby a visually exciting and interest generating advertising/promotional display product is attained which enables the user to manually control the indicia displayed thereon.

2. The advertising/promotional display product defined in claim 1, wherein the number of indicia bearing zones formed on the first panel is equivalent to the number of cut out zones formed on the second panel and the total number of arm members/sliders associated therewith.

3. The advertising/promotional display product defined in claim 2, wherein the arm member/slider is further defined as comprising two adjacent sections which comprise an overall size and shape which is greater than the area formed by the indicia contained in two adjacent indicia bearing zones of the first panel.

4. The advertising/promotional display product defined in claim 1 wherein each arm member/slider is movably mounted to the first panel for being slidingly activated by the user for movement between a first position wherein said first section is in overlying relationship with its associated indicia bearing zone, and a second position wherein the first section is positioned below the adjacent indicia bearing zone and the second section extends outwardly from the first panel member.

5. The advertising/promotional display product defined in claim 4, wherein the first section of each arm members/slider comprises indicia formed thereon for being displayed through the cut out zone of the second panel whenever the first section is aligned with the cut out zone of the second panel while being in overlying relationship with its associated indicia bearing zone of the first panel.

6. The advertising/promotional display product defined in claim 5, wherein the second section of each arm member/slider comprises indicia formed thereon for being displayed whenever the arm member/slider is moved into its second position with the second section extending outwardly from the first panel member.

7. The advertising/promotional display product defined in claim 6, wherein said first panel further comprises cutaway zones formed in cooperating association with the arm member/slider for enabling the user to readily grasp the leading edge of the arm member/slider for longitudinally moving the arm member/slider relative to the first panel.

8. The advertising/promotional display product defined in claim 4, wherein each arm member/slider is further defined as comprising stop means associated therewith constructed for cooperating with blocking means formed on the first panel for controlling and limiting the longitudinal movement of the arm member/slider relative to the first panel.

9. The advertising/promotional display product defined in claim 8, wherein said stop means is further defined as comprising cooperating ledges extending outwardly from the side edges of each arm member/slider substantially along the juncture between the first section and the second section thereof.

10. The advertising/promotional display product defined in claim 9, wherein the blocking means comprise finger members formed along one of the slots of the first panel in juxtaposed facing relationship with each other, positioned for cooperatingly engaging and holding the stop means of the arm member/slider.

11. The advertising/promotional display product defined in claim 4, and further comprising a transparent panel mounted to the second panel in association with the cut out zones formed therein.

12. The advertising/promotional display product defined in claim 11, wherein the transparent panel is further defined as being securely affixed to the second panel and incorporates indicia formed thereon for being displayed through the cut out zones of the second panel.

13. The advertising/promotional display product defined in claim 12, wherein the first section of each arm member/slider is further defined as comprising a uniform color for providing a desired background to the indicia formed on the portion of the transparent panel associated therewith.

14. The advertising/promotional display product defined in claim 13, wherein the indicia formed in each of the zones of the first panel is further defined as comprising the identical indicia formed on the transparent panel and a plurality of additional indicia for providing further emphasis, color, and distinguishing characteristics to the indicia of the transparent panel, whereby movement of each arm member/slider causes the observer to see the substantially increased visual display.

15. The advertising/promotional display product defined in claim 4, wherein said first panel member comprises four separate and independent indicia bearing zones, while the second panel member comprises four separate and independent cut out zones, each being associated with one of said indicia bearing zones.

16. The advertising/promotional display product defined in claim 15, wherein said product further comprises four separate and independent arm member/sliders cooperatively associated with the indicia bearing zones and the cut out zones thereof.

17. The advertising/promotional display product defined in claim 4, wherein the product is further defined as comprising a housing which incorporates a rear panel, with said rear panel comprising the first panel member and the second panel member pivotally mounted thereto along adjacent edges thereof for being positioned in cooperating, overlying, aligned relationship with each other.

* * * * *